United States Patent [19]

Radom et al.

[11] 3,994,120

[45] Nov. 30, 1976

[54] APPARATUS FOR PRODUCTION OF YARN FROM NATURAL AND CHEMICAL FIBRES

[75] Inventors: Czeslaw Radom; Ryszard Karol Jozwicki; Stanislaw Jozef Kropiwnicki; Henryk Kubica; Mieczyslaw Hertz, all of Lodz, Poland

[73] Assignee: Instytut Wlokniennictwa, Lodz, Poland

[22] Filed: July 25, 1974

[21] Appl. No.: 491,653

[52] U.S. Cl. ..... 57/58.89; 57/58.95

[51] Int. Cl.[2] ..... D01H 1/12

[58] Field of Search ..... 57/58.89–58.95, 57/77.3, 340

[56] References Cited

UNITED STATES PATENTS 3,577,720 5/1971 Zax et al. ..... 57/58.89

3,851,455 12/1974 Jozwicki et al. ..... 57/58.95

*Primary Examiner*—John Petrakes

*Attorney, Agent, or Firm*—Haseltine, Lake & Waters

[57] ABSTRACT

Apparatus for production of yarn from natural or chemical fibres comprising a fixed annular chamber having opposite ends with a closure member at one of the ends having a duct therein for discharge of yarn. A suction pipe is introduced into the chamber at the other of its ends and a helical duct is formed between the outer surface of the suction pipe and the inner surface of the chamber through which air is introduced into the chamber in a helical whirl. A duct is disposed between the closure member and the suction pipe for introducing raw material into the chamber.

6 Claims, 4 Drawing Figures

APPARATUS FOR PRODUCTION OF YARN FROM NATURAL AND CHEMICAL FIBRES

The invention relates to an apparatus for production of yarn from natural and chemical fibres by application of a pneumatic method.

The known apparatus used for pneumatic spinning in a stationary whirl includes nozzles situated in the generatrix of a spinning chamber, these nozzles being tangential to the inner wall of this chamber. The tangentially disposed nozzles cause the air induced into the spinning chamber to be swirled. In the apparatus of this type a change in the flow direction of the air induced into the cylindrical chamber takes place at the outlet of nozzles to the chamber. The direction of the stream of air flowing in the nozzles is in a plane perpendicular to the center line of the chamber, and at the outlet of the chamber this direction changes to that in a plane inclined to the said center line. Furthermore, the rectilinear motion of the air in the nozzles changes to a helical motion about the center line of the chamber.

The invention is directed to equipment for production of yarn from natural and chemical fibres, in which the helical ducts through which the air is introduced into the spinning chamber are situated between the wall of the spinning chamber and the wall of a pipe through which the air is sucked off. Through these ducts the whirled stream of air flows into the spinning chamber creating a zone in which the stationary whirl of fibres takes place.

The helical ducts situated between the inner wall of the spinning chamber and the outer wall of the air supply pipe can be used in spinning equipment with a tangential or axial admission.

Figure 1:
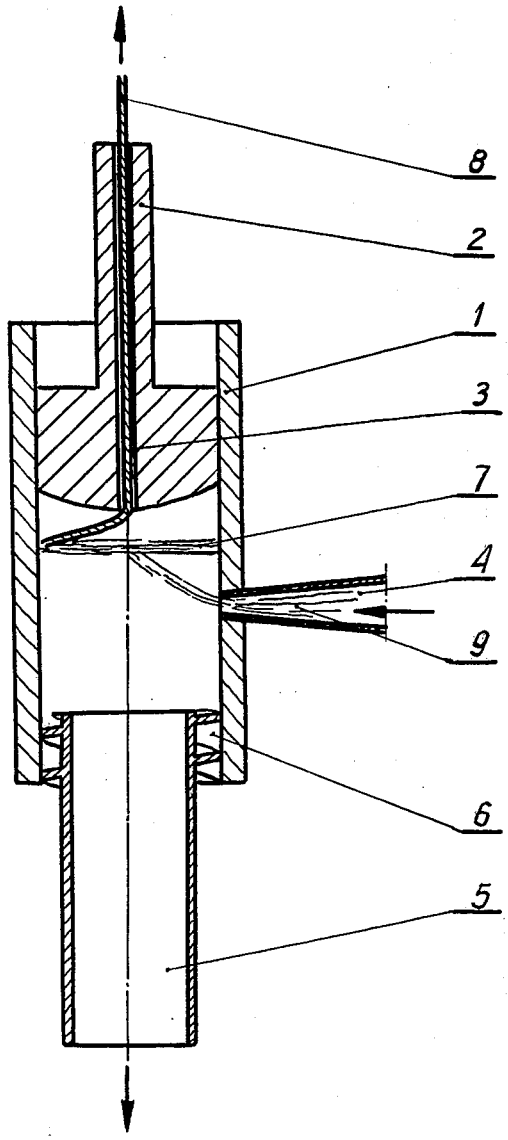
Figure 2:
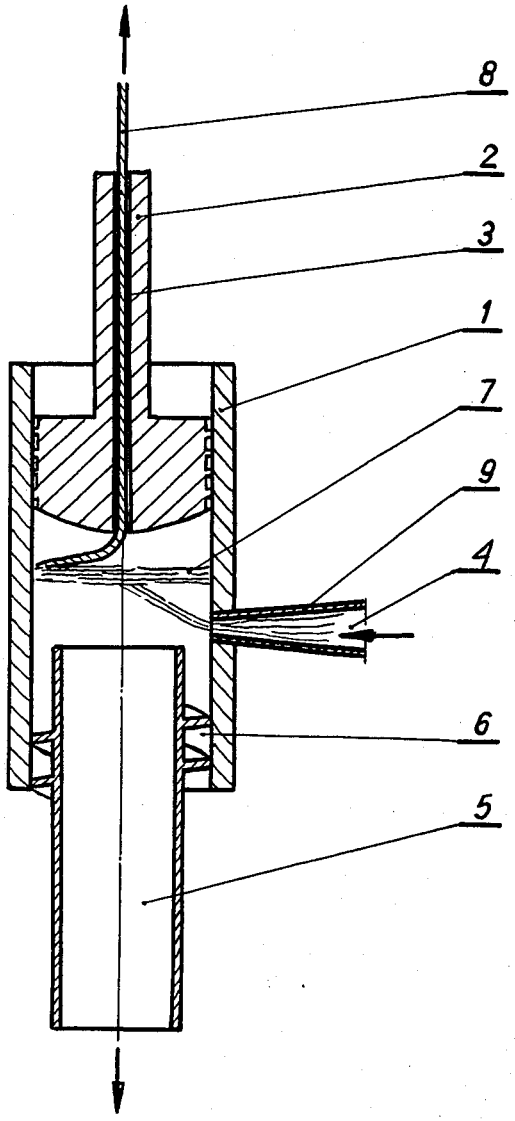
Figure 3:
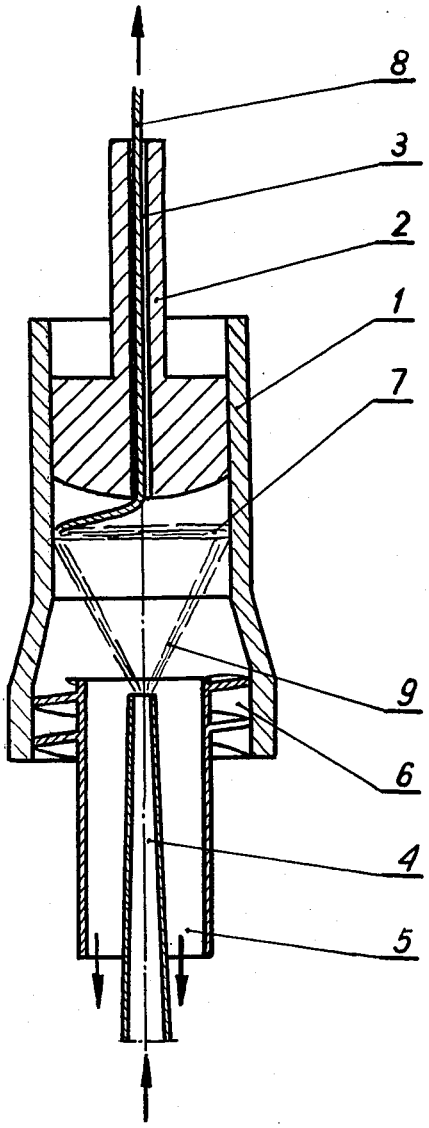
Figure 4:
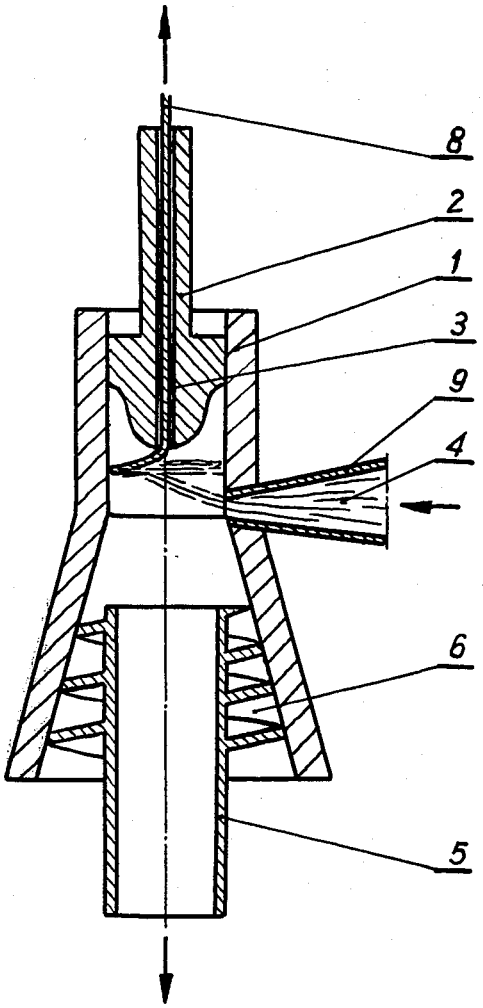

An embodiment of the invention is illustrated in the accompanying drawing in which:

FIG. 1 is a side elevational view in section of equipment with tangential admission, and FIGS. 2, 3 and 4 are similar views showing modifications of the equipment, FIG. 3 showing tangential admission.

The equipment of the invention consists of a cylindrical and non-rotary spinning chamber 1, one end of which is closed by a movable barrier 2, said barrier having a coaxial duct 3 therein for discharge of yarn 8. A pipe 4 for introduction of raw material 9 is situated tangentially with respect to the inner chamber 1 in FIGS. 1, 2 and 4 and axially in FIG. 3. A pipe 5 is inserted in the base of the chamber 1, for sucking off the air, said pipe being coaxial with the chamber 1 and having a circular cross-section, the outer diameter of the said pipe being smaller than the inner diameter of the chamber 1. There are helical ducts 6 formed between the inner wall of the chamber 1 and the outer wall of pipe 5, said ducts serving for introduction of air into chamber 1. The number and the size of the outlets of the helical ducts 6, as well as the angle of their inclination in relation to the plane of the cross-section of the chamber 1, depend on the diameter of the chamber 1, and of the pipe 5 through which the air is sucked off.

In the embodiment illustrated in FIG. 2, the inlet of pipe 5 through which the air is sucked off is situated at a higher level in the chamber than the helical ducts 6.

In the embodiment illustrated in FIG. 3, the inner diameter of the spinning chamber 1 is larger in the zone of the helical ducts 6 as compared to the diameter of the chamber in the zone of a stationary whirl of fibres 7, and the transition from the larger diameter into the smaller one has the form of a truncated cone.

In the embodiment of the invention illustrated in FIG. 4, the cross-sections of the ducts 6 through which the air is introduced into the chamber 1 decrease in the direction of the air inlet to the chamber 1.

In the apparatus according to the invention, the loss in air flow is reduced since the change in the direction of the air flow is eliminated, a higher speed of the stationary whirl of fibres in the chamber can be obtained, and the power consumption per unit of the produced yarn can be reduced.

What we claim is:

1. Apparatus for production of yarn from fibers, said apparatus comprising a fixed annular chamber having opposite ends, a closure member at one of said ends, said closure member having a duct therein for discharge of yarn, a suction pipe at the other end of said chamber, a duct for introducing raw material into said chamber between said closure member and said suction pipe, said suction pipe being inserted into said chamber, and means between said suction pipe and said chamber forming a helical duct through which air is introduced in a helical whirl into said chamber.

2. Apparatus as claimed in claim 1 wherein said suction pipe has an end in said chamber at a level above said helical duct.

3. Apparatus as claimed in claim 1 wherein said chamber has an enlarged diameter in the region of said helical duct.

4. Apparatus as claimed in claim 1 wherein said helical duct has a constant cross-section throughout its length.

5. Apparatus as claimed in claim 1 wherein said helical duct has a decreasing cross-section in the direction into the chamber.

6. Apparatus as claimed in claim 1 wherein said means comprises a helical rib formation on said suction pipe.

* * * * *